United States Patent [19]

Swenson et al.

[11] Patent Number: 4,718,981

[45] **Date of Patent: * Jan. 12, 1988**

[54] BLEACHED KRAFT PAPERBOARD BY DENSIFICATION AND HEAT TREATMENT

[75] Inventors: Roy S. Swenson, Ringwood, N.J.; Donald M. MacDonald, Monroe; Michael Ring, Warwick, both of N.Y.

[73] Assignee: International Paper Company, Purchase, N.Y.

[ * ] Notice: The portion of the term of this patent subsequent to Sep. 8, 2004 has been disclaimed.

[21] Appl. No.: 768,642

[22] Filed: Aug. 23, 1985

[51] Int. Cl.[4] ..... D21F 11/00

[52] U.S. Cl. ..... 162/206; 162/100

[58] Field of Search ..... 162/13, 28, 100, 142, 162/150, 206, 207

[56] References Cited

U.S. PATENT DOCUMENTS

| | | | |
|---|---|---|---|
| 2,116,544 | 5/1938 | Schur . | |
| 2,120,137 | 6/1938 | Mason . | |
| 2,802,403 | 8/1657 | Boehm . | |
| 3,319,352 | 5/1967 | Haigh | 162/206 |
| 3,354,035 | 11/1967 | Gottwald et al. . | |
| 3,531,371 | 9/1970 | Jordansson et al. . | |
| 3,533,906 | 9/1970 | Reiniger . | |
| 3,560,297 | 2/1971 | Back et al. . | |
| 3,677,850 | 7/1972 | Holt et al. . | |
| 3,875,680 | 4/1975 | Back et al. . | |
| 3,880,975 | 4/1975 | Lundmark . | |
| 4,032,394 | 6/1977 | Back . | |
| 4,385,172 | 5/1983 | Yasnovsky et al. . | |

FOREIGN PATENT DOCUMENTS

| | | | |
|---|---|---|---|
| 1424682 | 2/1976 | United Kingdom | 162/206 |

OTHER PUBLICATIONS

Anderson & Back, "The Effect of Single Nip Press Drying . . . ", Pulp & Paper Canada, vol. 77, No. 12, pp. 82–87 (1976).

Back et al., "Wet Stiffness by Heat Treatment of the Running Web", Pulp & Paper Canada, vol. 77, No. 12, pp. 97–106 (1976).

Back et al., "Wet Stiffness by Means of Heat Treatment of Running Web", Pulp & Paper Canada, vol. 78, No. 11, pp. 111–115 (1977).

Back et al., "Bonding in Paper Webs at Water Deficient Conditions", 1978–place of publication unknown.

Back et al., "Multistage Press Drying of Paper", reprint from Svensk Papperstidning, No. 2–197982 (1979) pp. 35–39.

Back, "The Relative Moisture Sensitivity of Compression . . . ", paper presented Oct. 1985 to Oxford Fundamental Research Symposium.

Seth et al., "The Effect of Press-Drying on Paper Strength", 1985 Papermakers Conference, pp. 249–256.

Setterholm, "An Overview of Press Drying", Tappi Journal, vol. 62, No. 3, pp. 46–46 (1979).

Norberg & Back, "Effect of Hot Pressing Temperature on the Properties of Hard and Semi-Hard Fibre Building Boards", Svensk Papperstidning, vol. 71, No. 15, pp. 774–787 (1968).

Back et al., "The Present State of Press-Drying of Paper", Paper for 7th Fundamental Research Symposium (1981).

Anderson and Back, untitled paper presented at European Conference (Oct. 1977).

Back, "Some Effects of Short Hot Press Nips on Wet Webs", date and place of publication unknown.

Back, "The Effect of Press Drying on Properties of Liner of High Yield Pulp", date and place of publication unknown.

(List continued on next page.)

*Primary Examiner*—Peter Chin

*Attorney, Agent, or Firm*—Walt Thomas Zielinski; Charles W. Fallow

[57] ABSTRACT

Both the wet strength and the folding endurance of bleached kraft paper product are improved by subjecting the paper to steps of densification and high temperature treatment during its production.

11 Claims, 2 Drawing Figures

OTHER PUBLICATIONS

Back et al., "The Dry, Hot Mouldability of Hardboard", Forest Products Journal, vol. 21, No. 9, pp. 96–100 (1971).

Back et al., "Bonding in Paper Webs Under Water-Deficient Conditions", Tappi Journal, vol. 62, No. 3, pp. 89–92 (1979).

Pease et al., "An Investigation into the Effects of High Pressure Wet Pressing . . . ", Tappi Journal, vol. 45, No. 7, pp. 150–153A (1962).

Stenberg, "Effect of Heat Treatment on the Internal Bonding of Kraft Liner", Svensk Papperstidning, No. 2, pp. 49–54 (1978).

Fraser, "Hot Mangle Presses Thick Particleboard in Continuous Ribbon . . . ", date and place of publication unknown.

Setterholm et al., "Press Drying of High-Yield Hardwood Pulp", Criteria for Fiber Product Design (FS-F-PL-3306) (1976).

Setterholm et al, "Variables in Press Drying Pulps from Sweetgum and Red Oak", USDA For. Serv. Res. Paper FPL 295, (1977).

BLEACHED KRAFT PAPERBOARD BY DENSIFICATION AND HEAT TREATMENT

BACKGROUND OF THE INVENTION

1. Field of the Invention

This invention relates to the art of papermaking, particularly to treating a bleached kraft paper product with pressure and heat to improve its wet strength while preserving its folding endurance.

2. Description of the Prior Art

The kraft process is a method of preparation of an aqueous slurry of fibers by treatment of a suitable renewable raw material. In most pulping process, a considerable portion of the natural lignin in wood, grass or other vegetative matter is rendered soluble by chemical reaction with one or more nucleophilic reagents. In the kraft process, the nucleophilic reagents are sulfide and hydroxide ions, which are used highly alkaline conditions. Variations of the kraft process include the earlier practiced soda process, using hydroxyl ions derived from metals in Group IA of the periodic table, namely lithium, sodium, potassium, rubidinium and cesium. A second variation involves the use of anthraguinone (AQ) or substituted anthraquinones as additional nucleophiles. Anthraquinone can be used in the soda process, in which case the process is known as the soda-AQ process, or in the kraft process which is then known as the kraft-AQ process. Such variations in the kraft process are well known in the industry and pulps prepared by any of these variations can be used in practicing the present invention.

If desired, the soda-AQ, kraft and kraft AQ pulps can be rendered white by application of suitable bleaching agents. Such agents are usually electrophilic in nature and may include chlorine, chlorine dioxide, sodium hypochlorite, hydrogen peroxide, sodium chlorite, oxygen and ozone. Use is often in sequential stages and a suitable nucleophilic agent, customarily hydroxyl ion, may be used in intermediate stages. "Kraft paper" is paper made from pulp produced by the kraft process. Bleached kraft paper, because of its low lignin content, has low wet strength; hence it is desirable to develop this quality of bleached kraft products.

In the art of making kraft paper products, it is conventional to subject felted fibers to wet pressing to unite the fibers into a coherent sheet. Pressure is typically applied to a continuous running web of paper by a series of nip rolls which, by compressing the sheet, both increase its volumetric density and reduce its water content. The accompanying FIG. 1 shows in simplified diagrammatic form a typical papermaking machine, including a web former and three representative pairs of wet press rolls. Also shown are drying rolls whose purpose is to dry the paper to a desired final moisture content, and a calendar stack to produce a smooth finish. At least some of the rolls are ordinarily heated to hasten drying. (The drawing is simplified—there are many more drying rolls in actual practice.)

There is currently considerable interest in treatments involving heat and pressure, or heat alone, during or after the production process, to improve various qualities of paper products. Qantifiable paper qualities include dry tensile strength, wet tensile strength, reverse folding endurance, compressive strength and stiffness, among others. Which qualities should desirably be enhanced depends upon the intended application of the product. For paper to be used in humid or wet environments, two qualities of particular interest are wet strength and folding endurance, both of which can be measured by well-known standard tests. As used herein, then, "wet strength" means wet tensile strength as measured by American Society for Testing and Materials (ASTM) Standard D829-48. "Folding endurance" is defined as the number of times a board can be folded in two directions without breaking, under conditions specified in Standard D2176-69. "Basis weight" is the weight per unit area of the dried end product.

Prior workers in this field have recognized that high-temperature treatment of linerboard can improve its wet strength. See, for example E. Back, "Wet stiffness by heat treatment of the running web", *Pulp & Paper Canada,* vol. 77, No. 12, pp. 97–106 (Dec. 1976). This increase has been attributed to the development and cross-linking of naturally occurring polysaccharides and other polymers, which phenomenon may be sufficient to preserve product wet strength even where conventional synthetic formaldehyde resins or other binders are entirely omitted.

It is important to note that wet strength improvement by heat curing has previously been thought attainable only at the price of increased brittleness (i.e., reduced folding endurance). Therefore, most prior high-temperature treatments have been performed on particle board, wallboard, and other products not to be subjected to flexure. The known processes, if applied to bleached kraft paper, would produce a brittle product. Embrittled paper is not acceptable for many applications involving subsequent deformation, and therefore heat treatment alone, to develop wet strength of bleached kraft products, has no gained widespread acceptance. As Dr. Back has pointed out in the article cited above, "The heat treatment conditions must be selected to balance the desirable increase in wet stiffness against the simultaneous embrittlement in dry climates." Significantly, in U.S. Pat. No. 3,875,680, Dr. Back has disclosed a process for heat treating already manufactured corrugated board to set previously placed resins, the specific purpose being to avoid running embrittled material through a corrugator. It is plain that added wet strength and improved folding endurance were previously thought incompatible results.

It is therefore an object of the invention to produce bleached kraft paper products having both greatly improved wet strength and good folding endurance. Another goal is to achieve that objective without resorting to synthetic resins or other added binders and wet strength agents.

With a view to the foregoing, a process has been developed which dramatically and unexpectedly increases not only the wet strength of bleached kraft paper, but also preserves its folding endurance. In its broadest sense, the invention comprises steps of (1) subjecting paper produced from bleached kraft pulp to high pressure densification, and (2) heating the board to an internal temperature of at least 420° F. (216° C.) for a period of time sufficient to increase the wet strength thereof. This method produces a product having folding endurance greatly exceeding that of similar paper whose wet strength has been increased by heat alone. This is clearly shown by our tests exemplified below.

While the tests set out in Examples 1–2 have carried out the invention in a static press, it is preferred that the heat and pressure be applied to continuously running paper by hot pressure rolls, inasmuch as much higher production rates can be attained.

We prefer to raise the internal temperature of the paper to at least 465° F. (240° C.), as greater wet strength is then achieved. This may be because at higher temperatures, shorter step duration is necessary to develop bonding, and there is consequently less time for fiber degradation to occur. Also, shorter durations enable one to achieve higher production speeds.

It should be noted that the heating rate, and thus the required heating duration at a particular temperature, depends on the method of heat transfer chosen. Furthermore, it is desirable to raise the web temperature as rapidly as possible to the chosen treating temperature. Improved heating rates can be achieved by using high roll temperatures and/or by applying high nip forces to the press roll against the sheet on the hot rolls. That high pressure dramatically improves heat transfer rates has previously been disclosed. One worker has attributed this to the prevention of vapor formation at the web-roll interface.

While the invention may be practiced over a range of temperatures, pressures and durations, these factors are interrelated. For example, the use of higher temperatures requires a heating step of shorter duration, and vice-versa. At 465° F., a duration of 60 seconds has been found sufficient to obtain the desired improvements, while at 420° F., considerably longer time is required.

It is presently preferred that, for safety reasons, the roll temperature be not greater than the web ignition temperature (572° F., 300° C.); however, even higher roll temperatures may be used if suitable precautions, such as the provision of an inert atmosphere, or rapid removal of paper from the hot environment, are taken.

DESCRIPTION OF THE PREFERRED EMBODIMENT

Figure 1:
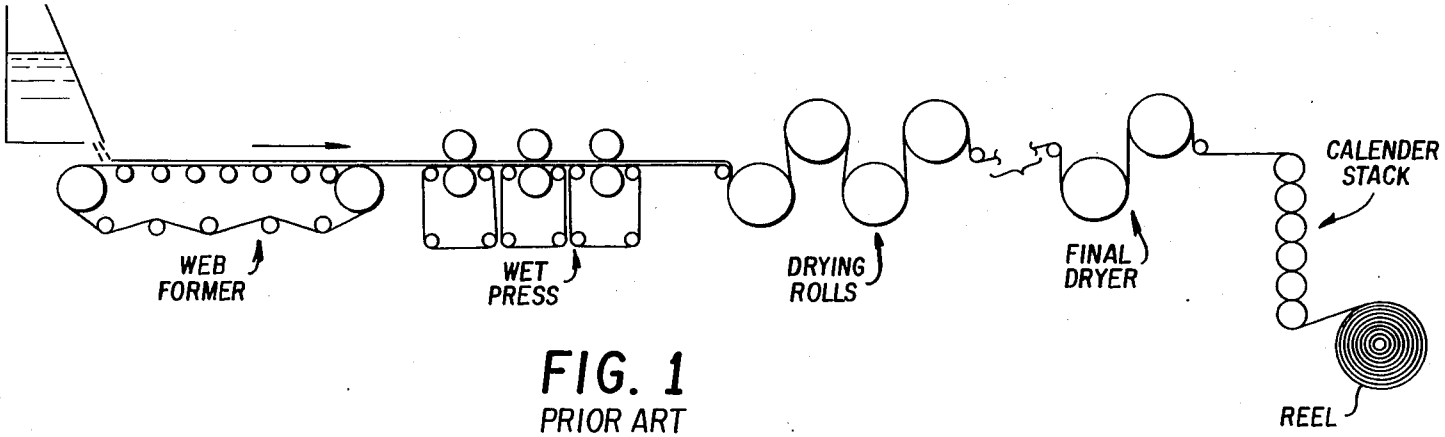
FIG. 1 PRIOR ART
FIG. 1 shows, in greatly simplified diagrammatic form, a conventional apparatus for producing kraft paper.
Figure 2:
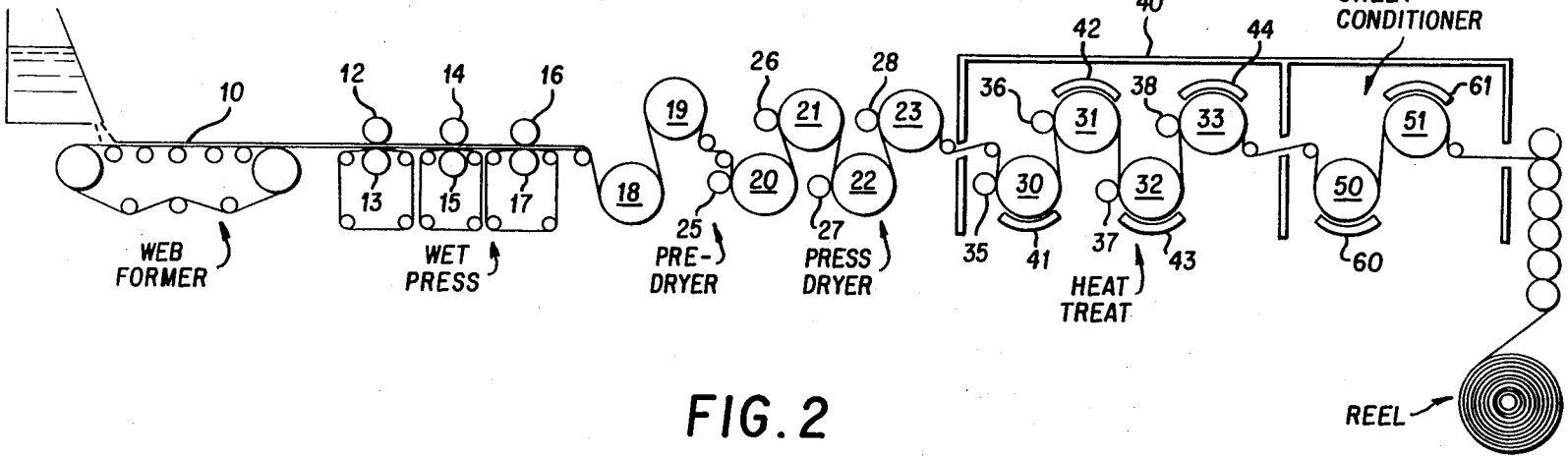
FIG. 2 shows, in like diagrammatic form, an apparatus for practicing the present invention.

FIG. 2 illustrates a preferred apparatus for carrying out the inventive process, although it should be understood that other devices, such as platen presses, can be used and in fact the data below was obtained from platen press tests. In the machine depicted, bleached kraft pulp fibers in aqueous suspension are deposited on a web former screen 10, producing a wet mat of fibers. The mat is then passed through a series of wet press nip rolls 12, 13, 14, 15, 16 and 17 which develop a consolidated web. Suitable wet presses known today include long nip presses and shoe-type presses capable of developing high unit press pressures on the wet fiber web. This step is known as "high pressure wet pressing". The web is then passed over pre-drying rolls 18, 19 to remove water from the wet web. Once the moisture content of the web has been reduced to less than 70% by weight, steps of the high pressure densification and high temperature treatment are applied according to the invention.

To densify the web, a series of drying rolls 20, 21, 22, 23 are provided with respective pressure rollers 25, 26, 27, 28 which are loaded sufficiently to produce a web density of at least 700 kg/m$^3$. We define this step as "press drying". In the preferred embodiment, the high pressure densification step of the invention is carried out both at normal drying temperatures (substantially below 400° F.) in the press drying section, and also in the high temperature heat treatment section described below. It should be understood, however, that the two steps may be performed sequentially or simultaneously.

In the heat treatment section, one or more drying rolls (e.g. 30, 31, 32, 33) is heated to or slightly above the desired maximum internal web temperature. Pressure rolls 35, 36, 37, 38 are used to improve heat transfer between the drying rolls and the web, and preferably, these pressure rolls are also highly loaded to continue the high pressure densification step during heat treatment. The drying roll temperature necessary to achieve target web temperature is a function of several factors including web thickness, web moisture, web entering temperature, web speed, nip pressure, and roll diameter; its calculation is within the skill of the art. It is presently believed optimum to achieve an internal web temperature of 465° F. (240° C.) and to maintain such temperature for sixty seconds. In any event, the roll temperature must be at least 420° F. (221° C.) which is well in excess of the temperature of normal drying rolls.

The heat treatment rollers are contained within an envelope 40, and air caps 41, 42, 43, 44 may be used to heat the web as it passes over each roller. An inert gas, stream or superheated steam may be used for this purpose and to prevent oxidation or combustion at high temperatures.

Following heat treatment, the web is passed over final drying rolls 50, 51 having air caps 60, 61 to condition the web. It is then calendered and reeled in a conventional manner.

The combined effect of high pressure densification and high temperature produce an unexpected combination of good wet strength and good folding endurance in the finished product.

The invention has been practiced as described in the following examples. The improvement in board quality will be apparent from an examination of the test results listed in the tables below.

EXAMPLE 1

Pine wood chips from the southeastern United States were cooked by the kraft process to an extent typical of pulp used in linerboard production. The cooked chips were converted to a pulp by passage through a disk refiner. The pulp was bleached and washed with water to remove residual black liquor and was stored in the wet state at 38°–42° F. (3°–6° C.) in a refrigerator until sheets were prepared. The cooked, bleached pulp contained substantially no lignin and had a freeness of 720 ml by the Canadian Standard Freeness test, which values are typical of a bleached pine linerboard pulp prior to beating.

A dispersion of the pulp in distilled water was converted to handsheets using a TAPPI sheet mold. The quantity of fiber in the dispersion was adjusted to give a TAPPI sheet weight of 3.6 g in the oven dried state, said weight being close to that of an air dried, 42 lb/1000 ft$^2$ (205 g/m$^2$) commercial linerboard sheet. The sheets were wet pressed with blotters at 60 psi (415 kPa) prior to drying.

Three sets of sheets were prepared. Sheets from the first set were dried on TAPPI rings at room temperature according to TAPPI standard T205 om-81. This is a conventional (C) drying procedure. Sheets from the second set were also dried by the conventional procedure but this procedure was followed by a heat treatment (HT). The paper sheet was placed between two 150 mesh stainless steel screens, which assembly was placed in the platen press. Heat treatment was in accordance with the conditions found optimum for this invention, namely 60 seconds at 465° F. (240° C.) sheet internal temperature. To do this, single sheets were placed in a 465° F. (240° C.) Carver platen press for 60 seconds with 15 psi (105 KPa) as applied pressure. Individual sheets from the third set were inserted in the wet state in a different platen press at 280° F. (138° C.). A pressure of 15 psi (105 KPa) was maintained for 5 seconds to dry surface fibers, after which the pressure was increased to 790 psi (5450 KPa) for 20 seconds. On completion of this press densification process (PD) sheet moisture was about 10%. Each sheet was removed from the PD press and immediately placed in the other, HT press for 60 seconds at 465° F. (240° C.). All three sets of sheets were conditioned at 73° F. (23° C.) and 50% humidity for at least 24 hours before testing.

Folding endurance and wet tensile strength were the tests that were carried out. Wet tensile tests were carried out immediately after excess water was blotted from test sheets which had been removed after 4 hours immersion in distilled water. Otherwise, this test was the same as the ASTM standard wet tensile test.

The results summarized in Table I show superior folding endurance and wet strength for the densified and heat treated sheets.

TABLE I

COMPARISON OF BLEACHED PINE KRAFT PAPERBOARD HANDSHEETS AFTER THE C, THE C + HT AND PD + HT PROCEDURES

| Treatment | Density kg/m$^3$ | Folding Endurance cycles | Wet Tensile Strength lb/in (KN/m) |
|---|---|---|---|
| C | 530 | 142 | 0.0 (0.00) |
| C + HT | 523 | 62 | 3.7 (0.65) |
| PD + HT | 766 | 391 | 5.5 (0.96) |

EXAMPLE 2

A southern hardwood bleached kraft pulp in the never-dried state was processed in accordance with the procedure in Example 1. The test results illustrate the lack of wet pulp strength and the somewhat brittle nature of conventionally dried hardwood pulp sheets. Heat treatment of the conventionally dried sheets produced rather mediocre wet strength accompanied by increased brittleness. However, sheets processed in accordance with this invention gave fold values improved by a factor of almost four over those of sheets conventionally treated and by an even greater factor over sheets that were heat treated, but not press dried, thereby demonstrating a pronounced lowering of brittleness in the (PD+HT) sheets, which also had significantly improved wet strength.

TABLE II

COMPARISON OF BLEACHED HARDWOOD KRAFT PAPERBOARD HANDSHEETS AFTER THE C, THE C + HT AND PD + HT PROCEDURES

| Treatment | Density kg/m$^3$ | Folding Endurance cycles | Wet Tensile Strength lb/in (KN/m) |
|---|---|---|---|
| C | 535 | 15 | 0.0 (0.00) |
| C + HT | 530 | 5 | 3.4 (0.60) |
| PD + HT | 652 | 57 | 6.1 (1.07) |

Inasmuch as the invention is subject to various changes and variations, the foregoing should be regarded as merely illustrative of the invention defined by the following claims.

We claim:

1. A method of maximizing the folding endurance of linerboard produced from bleached kraft pulp while improving its wet strength by heat treatment, comprising steps of:

forming a wet web of cellulose fibers from an aqueous suspension of fibers; then, without first drying the web, press drying said wet web, by compressing it sufficiently to produce a product having a density of at least 700 kg/m$^3$ and drying the product until its water content by weight is less than 10%; and then heat treating the product at an internal temperature of at least 420° F. (216° C.) for a time sufficient to increase both the wet strength and the folding endurance thereof as compared to a like product heat treated at the same internal temperature, but not press dried.

2. The method of claim 1, wherein said internal temperature is in the range of 420° F. (216° C.) to 572° F. (300° C.).

3. The method of claim 1, wherein said internal temperature is about 456° F. (240° C.) and wherein the duration of the heat treatment step is about sixty seconds.

4. The method of claim 1, wherein said paper product is paperboard.

5. The method of claim 4, wherein said linerboard has a basis weight in the range of 30 to 464 g/m$^2$.

6. The method of claim 4, wherein said linerboard has a basis weight of about 203 g/m$^2$.

7. A bleached kraft paperboard of high wet strength and high folding endurance, produced according to claim 2, 3, 4, 5 or 6.

8. A bleach kraft paperboard as in claim 7, having a wet strength of at least 5 lb/in, and satisfying a folding endurance test of at least 50 cycles.

9. A bleached kraft paperboard as in claim 7, having a wet strength of at least 15 lb/in, and satisfying a folding endurance test of at least 300 cycles.

10. The method of claim 1, wherein said heat treating step is for a duration sufficient to produce a wet strength of at least 15 pounds per inch.

11. The method of claim 1, wherein said densification includes applying sufficient pressure to the paper to produce density in range of 700–900 kg/m$^3$ prior to said heating step.

* * * * *